US005443593A

United States Patent [19]

Garofalo

[11] Patent Number: 5,443,593

[45] Date of Patent: Aug. 22, 1995

[54] SWIMMING FLIPPER

[75] Inventor: Giovanni Garofalo, Rapallo, Italy

[73] Assignee: H.T.M. Sport S.p.A., Italy

[21] Appl. No.: 167,081

[22] Filed: Dec. 15, 1993

[30] Foreign Application Priority Data

Jan. 20, 1993 [IT] Italy ..... GE93A0002

[51] Int. Cl.[6] ..... A63B 31/08; A63B 31/11

[52] U.S. Cl. ..... 441/64

[58] Field of Search ..... 441/61–64

[56] References Cited

U.S. PATENT DOCUMENTS

| | | | |
|---|---|---|---|
| 4,738,645 | 4/1988 | Garofalo | 441/64 |
| 4,887,985 | 12/1989 | Carofalo | 441/64 |
| 5,163,859 | 11/1972 | Beltrani et al. | 441/64 |
| 5,304,081 | 4/1994 | Takizawa | 441/64 |

FOREIGN PATENT DOCUMENTS

| | | | |
|---|---|---|---|
| 0308998 | 3/1989 | European Pat. Off. . | |
| 0436927 | 7/1991 | European Pat. Off. . | |
| 1296314 | 5/1962 | France | 441/64 |
| 2115724 | 7/1972 | France . | |
| 2332038 | 6/1977 | France . | |
| 2355529 | 1/1978 | France . | |
| 2494588 | 5/1982 | France . | |
| 0746764 | 3/1956 | United Kingdom | 441/64 |
| 1066618 | 1/1984 | U.S.S.R. | 441/64 |

*Primary Examiner*—Sherman Basinger
*Attorney, Agent, or Firm*—Larson and Taylor

[57] ABSTRACT

Swimming flipper of the type in which the flipper part has at least two or more channels for restricting and directing the streams of fluid generated during swimming, characterized in that said channels are made with opposite concavities.

17 Claims, 3 Drawing Sheets

Fig. 1

SWIMMING FLIPPER

BACKGROUND OF THE INVENTION

The present invention relates to swimming flippers and especially to flippers of the type in which the flipper part has two or more channels for restricting and directing the streams of fluid generated during swimming.

More specifically, but not exclusively, the invention relates to flippers of the type described above, in which said channels are made in a more pliable material than that of the rest of the flipper part.

The main drawback of known flippers of the type mentioned above is that said channels cause an excessive deformation or "elastic yielding" of the flipper part when the flipper stroke is in a direction which coincides with the concavity of said channels, whereas when the flipper stroke is in the opposite direction, the flipper part tends to become excessively rigid.

SUMMARY OF THE INVENTION

Therefore, the main aim of the present invention is to overcome the abovementioned drawbacks inherent in known flippers.

In accordance with the main feature of the present invention, the channels in a swimming flipper in which the flipper part has at least two flow channels, are made with opposite concavities.

Advantageously, according to a preferred embodiment of the present invention, the flippers have four adjacent channels on each flipper part, the two centremost channels being made with opposite concavities relative to those of the two side channels.

According to an additional feature of the invention, in the case of a flipper with three or more channels, the central channels are preferably made narrower than the side channels in order to limit even further the "elastic yielding" of the flipper part.

Further features and advantages of the flipper according to the invention will emerge more clearly on reading the following description of certain preferred embodiments of said flipper, said description being made with reference to the appended drawings in which:

DESCRIPTION OF THE PREFERRED EMBODIMENT OF THE INVENTION

Figure 1:
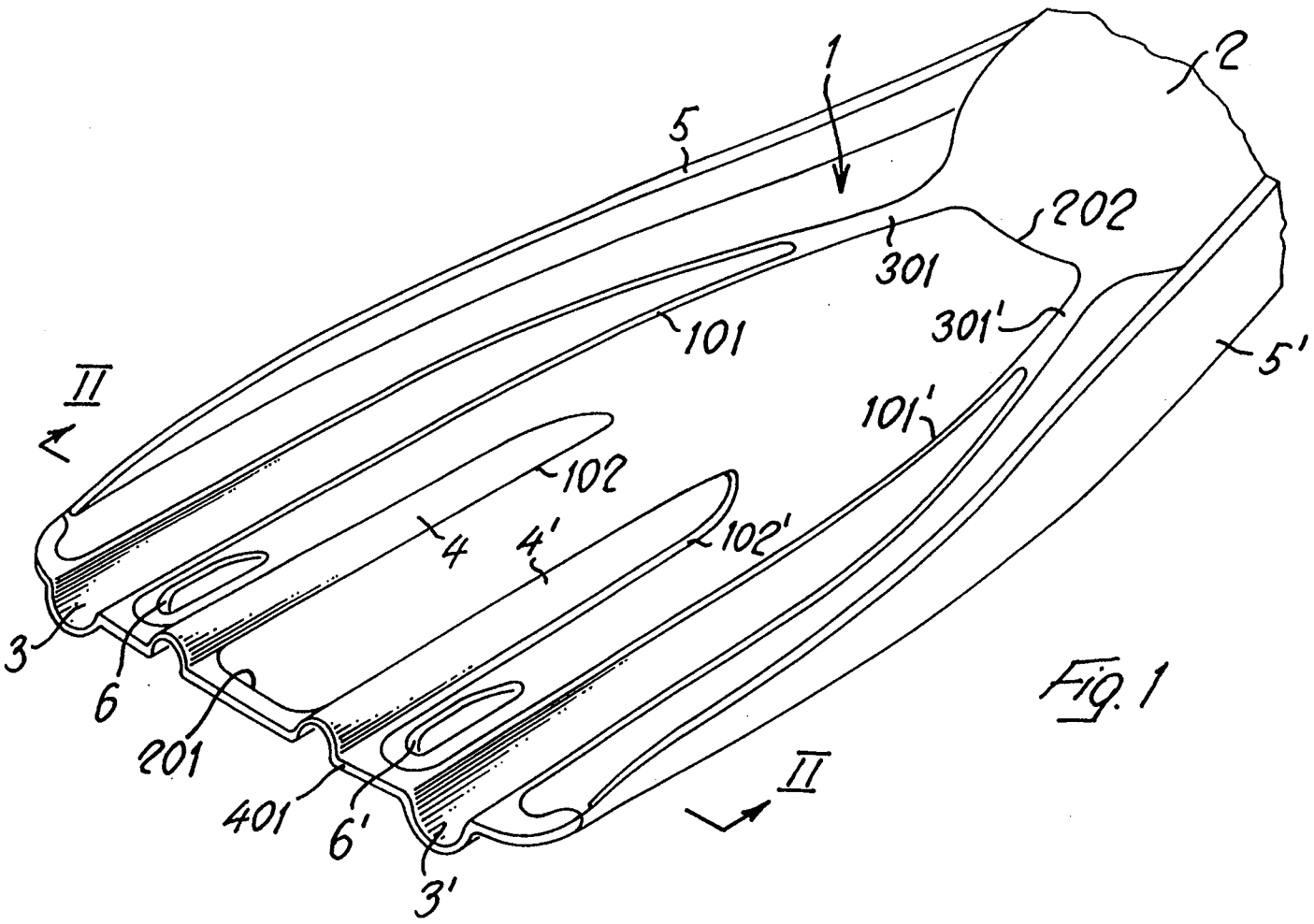
FIG. 1 is a perspective view of a swimming flipper having four flow channels according to the invention, in which the shoe part of the flipper has been partially cut away.
Figure 2:
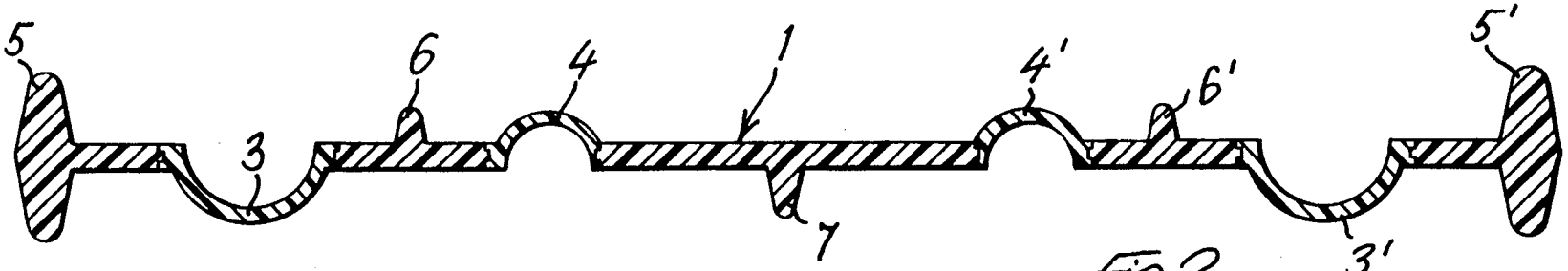
FIG. 2 is a cross-section along the line II—II of FIG. 1.

With reference to the drawings, and with particular reference to FIGS. 1 and 2 thereof, the flipper illustrated is of the type comprising a flipper part 1, obtained by moulding a relatively rigid material, joined by means of a further moulding operation to a shoe part 2 which is made of a softer material, of the consistency of rubber.

The flipper part 1 has slits 101, 101′, 102, 102′ formed in it which extend from the leading edge 201 of the flipper part 1 towards the middle in the direction of the base part 202 of said flipper part 1.

The flow channels 3, 3′, 4, 4′ are formed inside these slits 101, 101′, 102, 102′ by moulding using the same material as that used to mould the shoe part 2. Advantageously, the material used to form the flow channels 3, 3′ is directed into the rear ends of the side slits 101, 101′ at the time of moulding of the shoe 2, via injection ducts 301 formed in the flipper part 1, and comes out of the front of these side slits 101, 101′ after having formed the flow channels 3, 3′ by running along a front duct formed between the front end of the mould and the leading edge of the flipper, where it forms the front edge 401, then travelling as far as the two central slits 102, 102′, at which point it forms the flow channels 4, 4′.

In accordance with the invention, the flow channels 4, 4′ have an opposite concavity to that of the flow channels 3, 3′, as clearly illustrated in FIGS. 1 and 2. The flipper is completed in the usual way by the two side ribs 5, 5′ and has a series of small fins 6, 6′, 7 which, in addition to stabilizing the flipper during swimming, are also used to help position the flipper part 1 correctly in the mould in which the shoe part is injected, so as to prevent the sides of the flipper part moving during moulding of the channels 3, 3′; 4, 4′.

The advantages resulting from the flipper described will be self-evident The channels 3, 3′, 4, 4′ with opposite concavities allow:

a) improved channelling of the flow of fluid in both directions of flipper stroke, and b) excellent bending of the flipper in both stroke directions.

As illustrated, the central channels 4, 4′ are narrower than the side channels so as to further limit the "elastic yielding" of the flipper part 1 during swimming.

Figure 3:
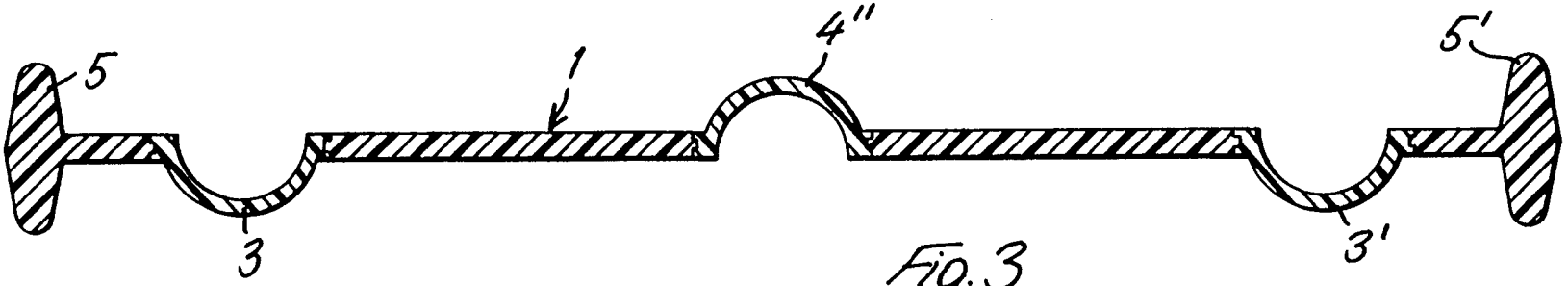
FIG. 3 is a cross-section, similar to that of FIG. 2, of an embodiment of a flipper having three flow channels.

FIG. 3 shows a variant, three-channelled embodiment of the flipper shown in FIGS. 1 and 2. According to this variant, the flipper part 1 has a single channel 4″ at its centre, this channel having an opposite concavity to that of the side channels 3, 3′, for the same purposes as those described with reference to the four-channelled flipper.

I claim:

1. A swimming flipper comprising:

a shoe portion;

a flipper part extending forwardly from said shoe portion to a fore edge, said flipper part being of a first material which is relatively stiff and having longitudinal slits therein;

flow channels formed in each of said longitudinal slits and extending rearwardly from said fore edge of the flipper part, said flow channels being of a second material which is less stiff than said first material;

at least one of said flow channels extending concavely away from the flipper part in one direction and another of said flow channels extending concavely away from said flipper part in the opposite direction.

2. The swimming flipper according to claim 1 comprising three flow channels, two of said flow channels extending concavely away from the flipper part in one direction and the third of said flow channels being positioned between said two flow channels and extending concavely away from said flipper part in the opposite direction.

3. The swimming flipper according to claim 1 comprising four flow channels, a first pair of said flow channels extending concavely away from the flipper part in one direction and the second pair of said flow channels being positioned between said first pair of flow channels and extending concavely away from said flipper part in the opposite direction.

4. The swimming flipper according to claim 3 wherein said second pair of flow channels are narrower than said first pair of flow channels.

5. The swimming flipper according to claim 1 further comprising small projections located on said flipper part between said flow channels.

6. The swimming flipper according to claim 1 wherein each of the flow channels is connected by said second material therein, said shoe portion also being of said second material, and the second material of at least one of said flow channels is connected to the shoe portion.

7. A swimming flipper comprising:

a shoe portion;

a flipper part extending forwardly from said shoe portion;

two longitudinal slits formed in the flipper part, said two longitudinal slits extending from a fore edge of the flipper part toward the shoe portion;

one or more longitudinal slits formed between said two longitudinal slits extending from a fore edge of the flipper part toward the shoe portion; and flow channels formed in the two longitudinal slits and the one or more longitudinal slits, said flow channels being concave, relative to the flipper part, said flow channels in the two longitudinal slits having the same concavity as each other, said concavity of the flow channels formed in the one or more longitudinal slits being opposite to the concavity of the flow channels in the two longitudinal slits.

8. The swimming flipper according to claim 7 wherein said flow channels in the one or more longitudinal slits are narrower than said flow channels in the two longitudinal slits.

9. The swimming flipper according to claim 7 wherein said one or more longitudinal slits comprise two longitudinal slits.

10. The swimming flipper according to claim 7 further comprising small projections located on said flipper part between said flow channels.

11. The swimming flipper according to claim 7 wherein said flipper part is formed from a relatively stiff material and the material of the flow channels is formed from a material which is softer than the material of the flipper part.

12. The swimming flipper according to claim 11 wherein each of the flow channels is connected by said second material therein, said shoe portion also being of said second material, and the second material of at least one of said flow channels is connected to the shoe portion.

13. A method of manufacturing a swimming flipper of the type having a flipper part which has a fore edge and a rear and a shoe portion adjacent the rear of the flipper part, the flipper part extending forwardly from the shoe portion, said method comprising the steps of:

forming a flipper part with a first material which is relatively stiff, said flipper part having one or more first longitudinal slits and one or more second longitudinal slits, all of the longitudinal slits extending to the fore edge of the flipper part, the one or more first longitudinal slits communicating with the rear of the flipper part;

with the flipper part in a mold, injecting a material softer than the material of the flipper part to form the shoe portion and causing the material to flow to form flow channels in the one or more first longitudinal slits and to flow along the fore edge to enter the one or more second longitudinal slits to form flow channels therein.

14. The method according to claim 13 wherein the flow channels in said one or more first longitudinal slits extend concavely away from the flipper part in one direction and the flow channels in said one or more second longitudinal slits extend concavely away from the flipper part in the opposite direction.

15. The method according to claim 13 further comprising the step of forming projections in said flipper part between all of said longitudinal slits for holding said flipper part in place in the mold during formation of said flow channels.

16. The method according to claim 15 wherein said projections comprise small fins.

17. A swimming flipper made in accordance with the method of claim 13.

* * * * *